US005729947A

United States Patent [19]

Dawes

[11] Patent Number: 5,729,947

[45] Date of Patent: Mar. 24, 1998

[54] COVERING

[76] Inventor: Michael Graham Dawes, 3 Leeway Avenue, Great Shelford, Cambridge CB2 5AU, United Kingdom

[21] Appl. No.: 637,810

[22] PCT Filed: Oct. 24, 1994

[86] PCT No.: PCT/GB94/02327

§ 371 Date: May 3, 1996

§ 102(e) Date: May 3, 1996

[87] PCT Pub. No.: WO95/12753

PCT Pub. Date: May 11, 1995

[30] Foreign Application Priority Data

Nov. 3, 1993 [GB] United Kingdom ..... 9322616
Aug. 2, 1994 [GB] United Kingdom ..... 9415588

[51] Int. Cl.[6] ..... E04D 1/12; E04D 1/34

[52] U.S. Cl. ..... 52/521; 52/536; 52/539; 52/546; 52/549; 52/553; 52/573.1; 52/DIG. 5

[58] Field of Search ..... 52/520, 521, 536, 52/541, 543, 544, 546, 539, 549, 551, 553, 573.1, 574, 591.4, DIG. 5, 537

[56] References Cited

U.S. PATENT DOCUMENTS

| | | | |
|---|---|---|---|
| 367,759 | 8/1887 | Little | 52/539 X |
| 1,330,493 | 2/1920 | Perrusi | 52/543 X |
| 1,969,918 | 8/1934 | Wright | 52/520 |
| 2,075,676 | 3/1937 | Toney | 52/551 X |
| 2,127,199 | 8/1938 | Austhoff | 52/541 X |
| 3,197,933 | 8/1965 | Burns et al. | 52/574 X |
| 3,212,223 | 10/1965 | Blok | 52/574 X |
| 3,226,898 | 1/1966 | Blok | 52/520 X |
| 3,228,159 | 1/1966 | Vecchiarelli et al. | 52/574 X |
| 3,253,375 | 5/1966 | Takehara | 52/520 X |
| 4,348,849 | 9/1982 | Wollam et al. | 52/545 |
| 4,422,274 | 12/1983 | Holliday . | |
| 4,930,282 | 6/1990 | Meadows . | |
| 5,020,293 | 6/1991 | Itagaki . | |

FOREIGN PATENT DOCUMENTS

| | | |
|---|---|---|
| 0381339 | 8/1990 | European Pat. Off. . |
| 1275684 | 11/1961 | France . |
| 3528776 | 2/1987 | Germany . |
| 3533512 | 4/1987 | Germany . |
| 7016713 | 4/1987 | Netherlands . |
| 107847 | 7/1917 | United Kingdom . |
| 940083 | 10/1963 | United Kingdom . |
| 1022666 | 3/1966 | United Kingdom . |
| 1350769 | 4/1974 | United Kingdom . |
| 2135355 | 8/1984 | United Kingdom . |

*Primary Examiner*—Carl D. Friedman
*Assistant Examiner*—Kevin D. Wilkens
*Attorney, Agent, or Firm*—Joel D. Skinner, Jr.; Skinner And Associates

[57] ABSTRACT

A covering for an underlying structure comprises a bottom layer of U-shaped sections with gaps between covered by an upper layer of inverted U-shaped sections, the sections having clearance holes and/or flexible edges to permit transverse thermal flexing. The bottom sections are attachable to the structure by clip elements previously attached to the structure.

7 Claims, 3 Drawing Sheets

COVERING

The present invention relates to a covering and especially coverings for buildings, e.g. a covering for a flat roof.

At present most domestic flat roofs have a multi-layer-felt covering. The effective lifetime of such a covering is no more than fifteen years.

The present invention seeks to overcome the above problem and to provide a weatherproof covering which would have an expected lifetime of between thirty and one hundred years depending upon the materials and the working environment.

U.S. Pat. No. 4,930,282 discloses architectural tiles, e.g. of plastic, forming a roof or wall covering. Bottom tiles are arranged side-by-side with no special measures being taken to compensate for thermal movement thereof. Top tiles are also arranged side-by-side.

Furthermore, NL-A-7016713 discloses a covering comprising a bottom layer of sections defining a plurality of U-shaped channels and an upper layer of sections defining a plurality of inverted generally U-shapes which cover the gaps between the sections of the bottom layer.

According to a first aspect of the present invention there is provided a covering for an underlying structure comprising a bottom layer of sections defining a plurality of U-shaped channels and an upper layer of sections defining a plurality of inverted generally U-shapes which cover the gaps between the sections of the bottom layer, characterised in that at least the sections in the bottom layer incorporate means permitting movement thereof in response to both thermal expansion and thermal contraction.

Said movement is preferably in the plane of the covering; an advantage of this is that buckling is avoided.

The bottom and upper sections preferably comprise means for interconnection in the form of clip elements, e.g. in the form of hooks.

The arm portions of the U-shaped bottom sections preferably have outwardly extending flange portions having means permitting connection of the bottom sections to each other and to the underlying structure such as a roof deck.

The edges of the sections may be rendered flexible by an adjacent groove and/or the centre of the sections may have a longitudinal region folded in the manner of a letter Z to permit transverse flexing.

In arrangements according to the invention, the material of the bottom sections is selected from plastics material, sheet metal material, ceramic material or composite material and the material of the upper sections, irrespective of the choice of material for the bottom sections, is selcted from plastics material, sheet metal material, ceramic material or composite material. Sections of ceramic material can be conveniently interconnected by sliding and provide good heat shielding.

The present invention is at least partly based on the consideration that much deterioration of existing flat roof coverings is caused by restrained expansion and contraction, especially that resulting from rapid changes in sunlight and shadow.

According to a second aspect of the present invention, there is provided a covering comprising at least one layer of sections arranged to be secured to a structure by means of a spaced array of clip elements, wherein the clip elements each comprise at least two spaced clip projections including limbs extending at least partly in a direction generally perpendicular to the structure, and the sections comprise formations for engaging with the clip elements and corrugations having spaced portions extending at least partly in a direction generally perpendicular to the structure, wherein at least portions of said limbs of said clip projections are located directly adjacent to said portions of the corrugations whereby, after engaging said formations with said clip elements, opening of said clip elements to release the section is resisted.

This provides a covering which is easily and quickly installed, but is then difficult to remove by pulling or twisting.

Preferred embodiments of the present invention will now be described by way of example only, with reference to the accompanying drawings, of which:

Figure 2A:
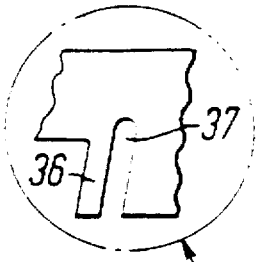
FIG. 2 is an enlarged sectional view on the line A—A of FIG. 1.
Figure 2:
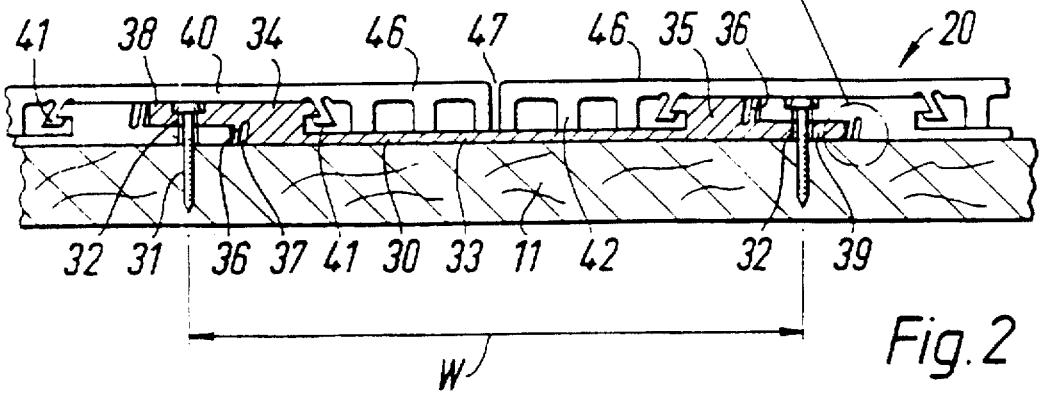
Figure 3:
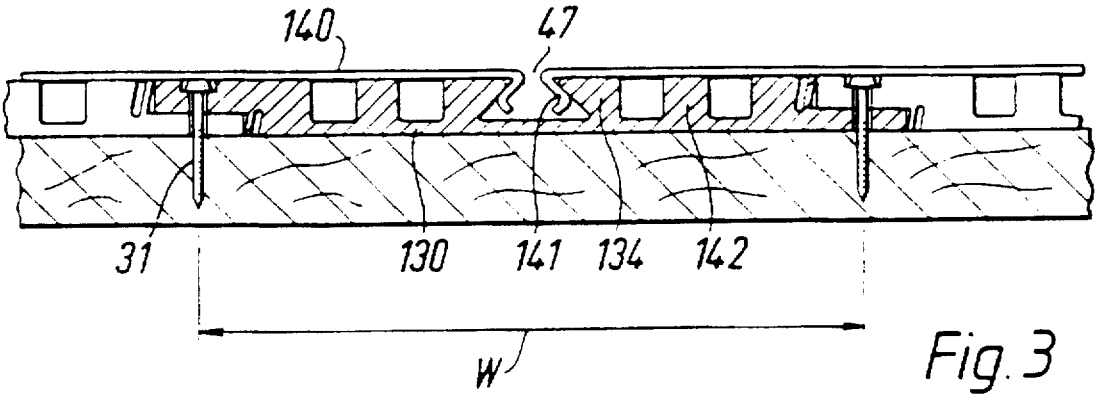
Figure 4:
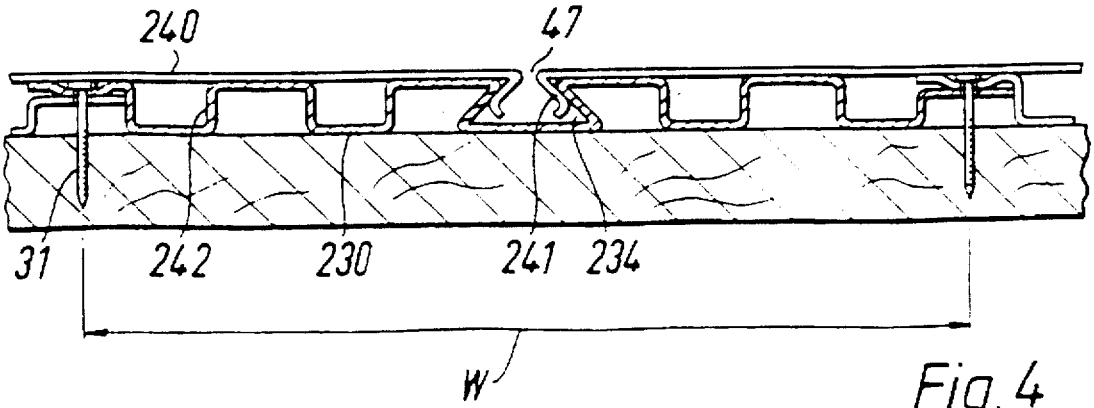
Figure 5:
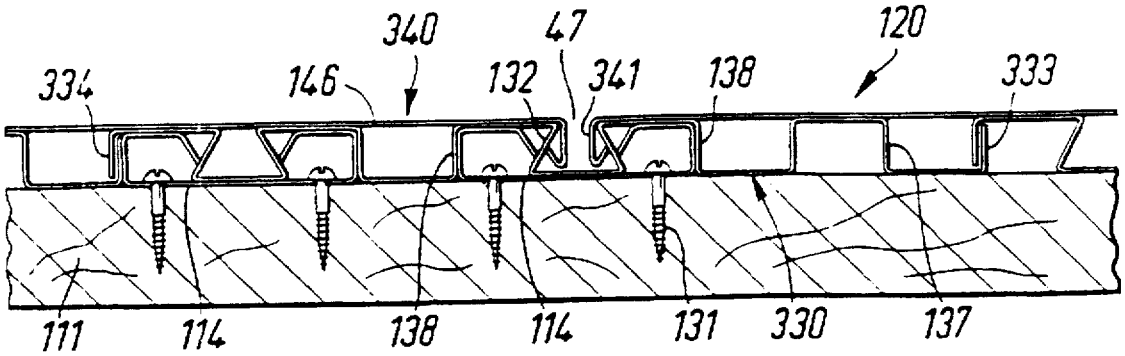
Figure 6:
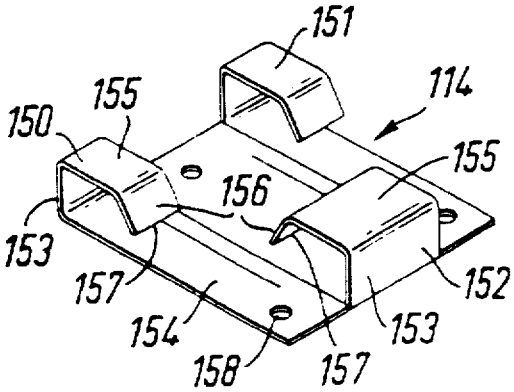
Figure 8:
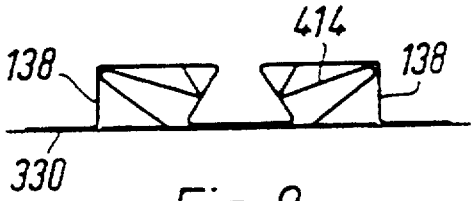
Figure 7:
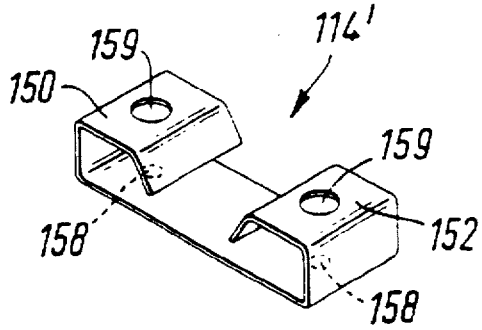
Figure 9:
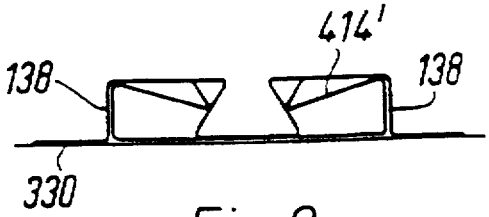

FIG. 2*a* is a further enlarged view of a part of FIG. 2;

FIG. 3 is a sectional view corresponding to FIG. 2 of a second embodiment of the present invention;

FIG. 4 is a similar view of a third embodiment of the present invention;

FIG. 5 is a similar view of a fourth embodiment of the present invention;

FIGS. 6 and 7 are perspective views of clips for use in the embodiment of FIG. 5; and FIGS. 8 and 9 show cross-sectional views of alternative clips to those of FIGS. 5 to 7.

Figure 1:
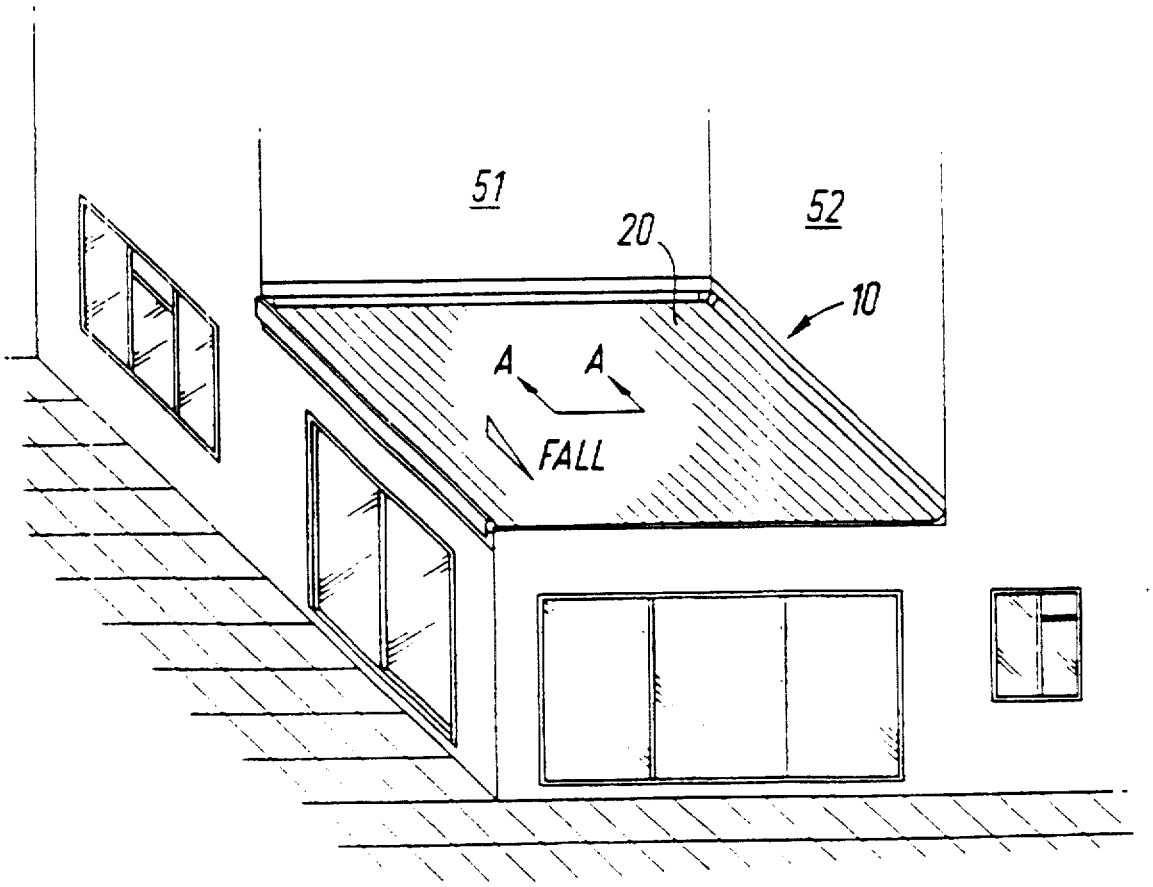
FIG. 1 is a perspective view of a flat roof with a covering in accordance with a first embodiment of the present invention.

Referring to the drawings, FIG. 1 shows a flat roof 10 having a fall or slope of at least 1 in 60 and provided with a covering 20 in accordance with the present invention. Covering 20 comprises a weatherproof membrane having two layers of interlocking, parallel sections 30,40 of plastics material. Sections 30 constitute the bottom layer and sections 40 constitute the top layer. All the sections have their lengths aligned with the maximum fall of the roof. The covering 20 also comprises some additional sections for trimming the edges of roof 10.

The bottom sections, such as 30 shown shaded in FIG. 2, are fixed to the roof deck 11 using nails 31 through drilled clearance holes or slots 32 in the sections 30. Each section 30 has the general form of a shallow channel with a web portion 33 and short arm portions 34,35.

Portion 34 has a flexible edge 36 formed by slot 37 at a small spacing from the edge, see FIG. 2*a*. Projecting outwardly from portion 34 is a further portion 38 spaced from roof deck 11 and having a hole or slot 32 arranged to receive a nail 31. Portion 35 also has a flexible edge 36. Portion 35 also has further portion 39 projecting outwardly therefrom arranged to lie against the roof deck 11 and also having a hole or slot 32.

Each top section 40 is clipped or slid onto the mating edges of two sections in the bottom layer, thereby covering and sealing the joins and fixings in the bottom layer. One end of each top layer section (at the highest edge of the roof) is fixed to the edge trim, sections underneath, and roof deck with a single nail aligned with the nails 31,32 and covered by an additional edge trim.

For securing a top section 40 to the bottom layer, it is provided with hook projections 41 which engage with the hook-shaped edge of a projection 34 of one bottom section 30 and of a projection 35 of the adjacent bottom section 30. The top faces 46 of sections 40 are formed as anti-slip surfaces and spacing members 42 avoid flexing of the sections 40 towards web sections 33.

The following is a brief description of the method of construction of roof 10.

Referring to FIGS. 1 and 2, take an appropriate length of section 30 and align the left hand edge with the left hand edge of the roof. Push the end of section 30 near the rear wall into firm contact with a seal on the wall (not shown), and fix the section to the roof deck or purlins as shown in FIG. 2.

Take a second length of section 30 and slide the left hand edge over the right hand edge of the first section. Push the end of the second section near the rear wall into firm contact with the seal on the wall, and fix the section as shown in FIG. 2.

Take a matching length of section 40, place it on top of the joint between the two sections 30, press it down to clip it onto these sections as indicated in FIG. 2, push the end near the rear wall into firm contact with the seal on the rear wall, and fix the three sections to the roof deck or purlin at a single point near the rear wall.

Working from left to right, repeat the above procedures and fix additional sections 30 and 40 until the right hand edge of the last section 30 is within one section 30 width of the right hand wall.

Using a matching length of section 30 or a solid section of compatible material and equal thickness, cut the right hand edge to width so that it fills the gap between the adjacent section 30 and the right hand side wall, push the end near to the rear wall into firm contact with the seal on the rear wall, and fix the section to the roof deck or purlins underneath.

Using a matching length of section 40, cut the right hand edge to reduce the width so that when the left hand edge is clipped onto the last full width section 30, the right hand edge is against the right hand wall. Then push the end of the reduced width section near the rear wall into firm contact with the seal on the rear wall, and fix the section to the roof deck or purlins underneath.

Complete the roof construction by fixing and sealing the trims and flashings (not shown) to the edges of the roof, and also fixing the gutter and water downpipe (not shown) to the front edge of the roof.

The above described covering has two particular dimensions which are chosen to allow transverse movements of sections 30 and 40 under thermal effects. These dimensions are W, the effective width of the sections 30 and 40, and the minimum clearance between the nails 31 securing sections 30 to the roof deck and the holes 32 receiving the nails.

The selection of W is based on the following relationship:

$$W_{max}=\Delta W/(\alpha\Delta T) \quad [1]$$

where $W_{max}$=maximum width of section 40

$\Delta W$=maximum allowed transverse expansion of section 40

$\alpha$=coefficient of linear expansion $\Delta T$=maximum temperature rise or fall of section 40 after fixing it to the roof deck.

The value of $\Delta W$ corresponds to the effective initial spacing between adjacent sections 30. The effective initial spacing is achieved by having flexible edges on the 30 (see inset in FIG. 2*a*). Temperatures above those at the time each section 30 is fixed will cause transverse expansions, which will be accommodated by closure of the slots in the flexible edges and the clearances between the fixing nails 31 and the drilled holes or slots 32 in the section. Temperatures below those at which each section 30 is fixed will cause transverse contractions, which will also be accommodated by the clearances between the fixings and holes in the sections. The same design principles apply to any special edge sections. This will eliminate transverse thermal stresses in the bottom layer of sections in the roof covering.

The selection of W is based on $W \leqq W_{max}$, $\Delta W$=1 mm in order to minimise the gaps between the sections 40 and $\Delta T$=100° C. Substituting these values in Equation [1] gives $$W \leqq 10^{-2}/\alpha \quad [2]$$

The values for certain selected materials for the sections are given in Table 1 below:

TABLE 1

| | |
|---|---|
| Rigid UPVC | W ≦ 182 mm |
| Aluminum alloy | W ≦ 435 mm |
| Stainless steel | W ≦ 625 mm |
| Titanium alloy | W ≦ 1110 mm |

For UPVC a preferred width is 150 mm.

To prevent thermal stresses in the bottom layer section 30 it is necessary to make the clearances equal to the maximum expansions and contractions. This requires the transverse clearance to be equal to $\Delta W$, which as explained earlier, has been made equal to 1 mm. Therefore the drilled holes need to have a diameter 1 mm larger than the shank diameters of the fixing nails or screws.

The longitudinal clearance is required to be equal to $$\Delta L=L\alpha\Delta T \quad [3]$$

where $\Delta L$=longitudinal expansion or contraction

L=maximum length of bottom section $\alpha$=coefficient of linear expansion $\Delta T$=maximum temperature rise or fall of the bottom section after fixing it to the roof deck.

Hence, the required slot size to prevent transverse and longitudinal thermal stresses in the bottom sections is $$D\times S=(d+\Delta W)\times(d+\Delta L)$$

or $$D\times S=(d+1)\times(d+\Delta L),\ mm \quad [4]$$

where

D=drill diameter or slot width

S=slot length d=shank diameter of fixing nail or screw

It would be safe for worldwide use to take $\Delta T$=100° C. However, for use in the U.K. it would still be safe to take $\Delta T$=30° C. These values of $\Delta T$, L=5000 mm and Equation [3] have been used to determine the following values of $\Delta L$ for different material given in Table 2.

TABLE 2

| | | |
|---|---|---|
| Rigid UPVC | 8.25 mm | 27.5 mm |
| Aluminum alloy | 3.45 mm | 11.5 mm |
| Stainless steel | 2.4 mm | 8.0 mm |
| Titanium alloy | 1.35 mm | 4.5 mm |

The above described covering has numerous advantages. It provides a double-layer weather proof membrane which can be walked on and has an expected lifetime of at least 30 and usually 50 years. It is easily assembled; apart from at the edges assembly of the top layer sections is merely a clip-on or slide-on procedure.

The single fixing point of each top layer section 40 allows free longitudinal expansion and contraction of the section, guided only by the sections 30 underneath. The initial widths (W) and flexible edges of the bottom sections 30 will allow free transverse expansions of the top and bottom layer sections up to specified maximum value (ΔW). The inclusion of shade, air gaps and, in some instances, insulation between the top and bottom sections, ensures that the latter do not experience the high surface temperatures associated with direct sunlight on the top sections. This will result in generally smaller and less rapid expansions and contractions in the bottom sections.

This means that the membrane is able to absorb all differential expansions and contractions, thereby preventing out-of-plane distortions, thermal stresses and themally induced cracking.

The modular design of the flat roof membrane, allows localised damage to be repaired by replacing the damaged sections without disturbing the surrounding sections.

Numerous modifications may be made to the above-described covering. With minor changes at the edges it can be used for flat roofs with no adjacent wall. Although nails and screws have been mentioned in the above description, these elements are interchangeable and, indeed, any suitable type of fixing element may be employed.

The preferred material for the sections is extruded UPVC, but any other suitable plastics or metal material may be employed; different materials may be used for different sections.

Thus in a second embodiment, FIG. 3, the bottom sections 130 are of plastics material, whereas the top sections 140 are of sheet metal. This constitutes a particularly durable covering. It will be seen that spacing members 142 are part of the bottom sections in this embodiment. Moreover, top sections 140 have shaped end portions 141 which engage suitably-angled members 134 integral with the bottom sections.

In a third embodiment, FIG. 4, both top and bottom sections 240,230 are of sheet metal. Here, corrugations 242 in the bottom sections serve as spacing members. Again top sections 240 have shaped end portions 241 which engage in corresponding recesses 234 formed in the bottom sections 230.

In a further modification, the bottom sections 130 are of metal and the top sections 140 are of plastics material.

Where a metallic material is used, the transverse flexibility may be provided alternatively, or in addition, by a Z-shaped fold or pleat extending longitudinally along a central region of the sections 30 and 40. In embodiments such as that shown in FIG. 4, the intrinsic construction of the bottom section 230 may provide sufficient flexibility across the full width. In addition the angle of portions 241 may be made more acute than the angle of the mating parts of the bottom sections, and this feature too permits thermal flexing without deterioration.

Before fitting top sections 40, the joins between the bottom sections 30 and/or the fixing locations of the bottom sections may be covered with a weather proof covering such as aluminium foil adhesive tape. Top sections 40 may be narrower (e.g. by a factor of two) than bottom sections 30 if desired, or vice versa.

The covering may be applied to sloping roofs and to walls.

FIG. 5 shows a covering 120 in accordance with the present invention applied to the beams 111 of a building. Alternatively numeral 111 may represent the roof deck of a building, or a wall. Clip elements 114 are attached by screws 131 to the beams etc 111 at spaced locations therealong. The screws pass through holes 158 in the clip elements 114.

Each clip element 114, as shown in FIG. 6, comprises three tongues 150,151,152. Each tongue comprises a vertical limb 153 generally perpendicular to a base part 154 of the clip element. A generally horizontal limb 155 extends inwardly from the upper end of each limb 153 and a diagonal portion 156 with a free end 157 extends inwardly and downwardly from the inner end of limb 155. Through holes 158 are provided for screws 131.

Each bottom section 330 comprises a plurality of generally U-shaped corrugations 137 and one or more dovetail formations 132 with an upwardly directed edge 333 at one side and a downwardly directed edge 334 at the other side. The bottom sections 330 are securely attached to the building by clipping the dovetail formations 132 into clip elements 114. When doing this it should be ensured that the edges 334 overlap the edges 333 as shown. It should be noted that the vertical arms 138 of the corrugations 137 next to the dovetail formations 132 engage the vertical portion 153 of the clip elements 114. After assembly, this arrangement resists opening up of the clip elements 114 and thus prevents inadvertent release of the bottom sections 330. Furthermore, upward movement of the bottom sections 330 is resisted by free ends 157 engaging the sloping faces of the dovetail formations 132.

Top sections 340 have end clips 341 which are then clipped into selected formations 132 of the bottom layer so as to securely attach the top layer to the bottom layer and to provide a waterproof covering for the bottom layer and especially for the gaps between the edges 333,334 of the bottom sections.

An advantage of the above-described covering is that, once the layout of the clips has been determined, the covering can be quickly applied by relatively unskilled labour. A further particular advantage is that the resilient nature of the interconnection between dovetail formations 132 and clips 114 permits free transverse thermal expansion and contraction of the bottom sections 330.

Various modifications can be made to the above described arrangements. In particular top sections 40 etc can be completely omitted since bottom sections 30 etc alone provide an adequately waterproof covering in many cases. The coverings may be applied to horizontal flat roofs, sloping roofs or even to the walls of buildings as cladding. Clips 114,114 can be attached to roof decks in addition to wood or metal purlins and beam members.

The corrugations 137,242 of bottom sections 230,330 may be omitted and the dovetail formations 234,132 and associated clips 114 and 241,341 may be replaced by any suitable fastening arrangements which can be quickly assembled. The upper surface 46,146 of the top sections 40 etc (or, if the top sections are omitted, the upper surfaces of the bottom sections 30 etc) may be formed, coated or otherwise conditioned to provide slip resistance. To cater for round roofs or walls the sections 30,40 etc are tapered to match the curvature of the building and are laid accordingly.

For hostile environments, where there is a risk of crevice corrosion, the gaps 47 between the top sections may be filled with a flexible sealant such as silicone rubber. Alternatively, preformed synthetic rubber seals may be inserted in the gaps 47 and may extend down into the dovetail formations 234,132. An additional advantage of employing sealant or seals is the enhancement of the slip resistance of the upper surface of the top sections 40 etc.

In a modification, a plurality of clip elements 114, preferably at least three clip elements, are secured to a strip of sheet metal or plastics material at predetermined locations thereon. These strips are then secured in advance to the underlying purlins etc in any convenient manner including nailing, crimping, welding or adhering, or by means of tangs on the underside of the strips. This saves time spent on preparatory work and permits less skilled labour to be used.

The clip element 114 of FIG. 6 serves to resist substantial twisting forces. When such forces are not likely to be encountered, the clip element 114' of FIG. 7 may be employed instead. Tongues 150,152 are of similar cross-section to that of FIG. 6, but have through holes 159 to allow screws 131 to be inserted through holes 158.

FIGS. 8 and 9 show clamp elements 414,414' with respective modified cross-sections. The angled tongues serve to provide increased resistance to removal of the bottom section 330 once attached.

When the covering is for use on walls or other structures, the expressions "bottom", "top" and "vertical" etc should be construed accordingly. The coverings can be used not only for buildings, but for many other types of structures, including vehicles used for land, sea and air transportation. The coverings can also be used for internal walls, ceilings and floors, and in these applications the long cavities between the top and bottom sections can be used to conceal and protect cables and other items, which can be accessed by unclipping the top sections with a simple tool.

I claim:

1. A covering for an underlying structure comprising a bottom layer of sections defining a plurality of U-shaped channels with gaps therebetween and an upper layer of sections defining a plurality of inverted generally U-shapes which cover said gaps between the sections of the bottom layer, wherein the sections in the bottom layer incorporate means permitting, in response to thermal effects, movement of the sections of the bottom layer relative to the underlying structure and means permitting, in response to thermal effects, movement of the sections of the bottom layer relative to each other, wherein the means permitting movement relative to the underlying structure comprises a clearance hole or slot located in at least one of said channels of said bottom layer and arranged to receive a fixing element.

2. A covering according to claim 1, wherein arm portions of the U-shaped bottom sections have outwardly extending flange portions which incorporate said clearance holes or slots and permit connection of the bottom sections to each other and to said underlying structure.

3. A covering according to claim 1, wherein at least one of the bottom or upper sections incorporates spacing means extending between web portions of both the bottom and upper U-shaped sections, and the bottom sections comprise a plurality of corrugations to permit movement in response to thermal effects.

4. A covering according to claim 1, wherein the means permitting movement of the sections of the bottom layer relative to each other comprises a flexible edge.

5. A covering for an underlying structure comprising a bottom layer of sections defining a plurality of U-shaped channels with gaps therebetween and an upper layer of sections defining a plurality of inverted generally U-shapes which cover said gaps between the sections of the bottom layer, wherein the sections in the bottom layer incorporate means permitting, in response to thermal effects, movement of the sections of the bottom layer relative to the underlying structure and means permitting, in response to thermal effects, movement of the sections of the bottom layer relative to each other, wherein the means permitting movement of the sections of the bottom layer relative to each other comprises a flexible edge.

6. A covering for an underlying structure comprising a bottom layer of sections defining a plurality of U-shaped channels with gaps therebetween and an upper layer of sections defining a plurality of inverted generally U-shapes which cover said gaps between the sections of the bottom layer, wherein the sections in the bottom layer incorporate means permitting, in response to thermal effects, movement of the sections of the bottom layer relative to the underlying structure and means permitting, in response to thermal effects, movement of the sections of the bottom layer relative to each other, the covering further comprising a plurality of clip elements which are arranged to be secured in a spaced array on the surface of said underlying structure, wherein the clip elements are arranged to receive the bottom sections and each comprise at least two spaced clip projections including limbs extending at least partly in a vertical direction, and the bottom sections comprise formations arranged to engage with the clip elements and corrugations having spaced portions extending at least partly in a vertical direction, wherein at least portions of said limbs of said clip projections are located directly adjacent to said portions of the corrugations whereby, after engaging said formations with said clip elements, opening of said clip elements to release the bottom sections is resisted.

7. A covering comprising at least one layer of sections arranged to be secured to a structure by means of a spaced array of clip elements, wherein the clip elements each comprise at least two spaced clip projections including limbs extending at least partly in a direction generally perpendicular to the structure when secured thereto, and the sections comprise formations for engaging with the clip elements and corrugations having spaced portions extending at least partly in a direction generally perpendicular to the structure when secured to the clip elements, wherein at least portions of said limbs of said clip projections are located directly adjacent to said portions of the corrugations whereby, after engaging said formations with said clip elements, opening of said clip elements to release the section is resisted.

* * * * *